US009458386B2

(12) United States Patent
Long

(10) Patent No.: US 9,458,386 B2
(45) Date of Patent: Oct. 4, 2016

(54) OPTIMIZED CAUSTIC CONTROL BASED ON ORE GRADE AND FINES CONTENT FOR BITUMEN EXTRACTION FROM MINED OIL SANDS

(71) Applicant: SYNCRUDE CANADA LTD. in trust for the owners of the Syncrude Project, Fort McMurray (CA)

(72) Inventor: Jun Long, Edmonton (CA)

(73) Assignee: SYNCRUDE CANADA LTD., Fort McMurray (CA), in trust for the owners of the Syncrude Projectas such owners exist now and in the future ( * ) Notice: Subject to any disclaimer, the term of this patent is extended or adjusted under 35 U.S.C. 154(b) by 0 days.

(21) Appl. No.: 13/667,966

(22) Filed: Nov. 2, 2012

(65) Prior Publication Data

US 2014/0124412 A1 May 8, 2014

(51) Int. Cl.
*C10G 1/00* (2006.01)
*C10G 1/04* (2006.01)

(52) U.S. Cl.
CPC ..... *C10G 1/045* (2013.01)

(58) Field of Classification Search
CPC ..... C10G 1/00; C10G 1/04
USPC ..... 208/390, 391
See application file for complete search history.

(56) References Cited

U.S. PATENT DOCUMENTS 4,201,656 A 5/1980 Sanford

OTHER PUBLICATIONS

Sanford, E. Processibility of Athabasca Oil Sand: Interrelationship Between Oil Sand Fine Solids, Process Aids, Mechanical Energy and Oil Sand Age After Mining. Canadian Journal of Chemical Engineering 1983. pp. 554-567. vol. 61(4).

*Primary Examiner* — Walter D Griffin
*Assistant Examiner* — Derek Mueller
(74) *Attorney, Agent, or Firm* — Bennett Jones LLP

(57) ABSTRACT

A process of extracting bitumen from oil sand ores having a fines content up to about 60% and a bitumen content greater than 6% is provided, comprising: determining the fines content and the bitumen content of the oil sand ore; calculating a sufficient amount of caustic to be added in the process using an equation based on the ratio of the fines content to the bitumen content; mixing the oil sand ore with heated water to produce an oil sand slurry; and adding the sufficient amount of caustic before, during or after mixing the oil sand ore with heated water to condition the oil sand slurry and to improve bitumen recovery from the oil sand ore.

8 Claims, 7 Drawing Sheets

OPTIMIZED CAUSTIC CONTROL BASED ON ORE GRADE AND FINES CONTENT FOR BITUMEN EXTRACTION FROM MINED OIL SANDS

FIELD OF THE INVENTION

The present invention relates to a process of extracting bitumen from oil sand ores by adding a sufficient amount of caustic based on the ore grade and fines content to condition the oil sand slurry.

BACKGROUND OF THE INVENTION

Oil sand generally comprises water-wet sand grains held together by a matrix of viscous heavy oil or bitumen. Bitumen is a complex and viscous mixture of large or heavy hydrocarbon molecules. The Athabasca oil sand deposits may be efficiently extracted by surface mining which involves shovel-and-truck operations. The mined oil sand is trucked to crushing stations for size reduction, and fed into slurry preparation units where hot water and caustic (sodium hydroxide) are added to form an oil sand slurry. The oil sand slurry may be further conditioned by transporting it using a hydrotransport pipeline to a primary separation vessel (PSV) where the conditioned slurry is allowed to separate under quiescent conditions for a prescribed retention period into a top layer of bitumen froth, a middle layer of middlings (i.e., warm water, fines, residual bitumen), and a bottom layer of coarse tailings (i.e., warm water, coarse solids, residual bitumen). The bitumen froth, middlings and tailings are separately withdrawn. The bitumen froth is de-aerated, heated, and treated to produce diluted bitumen which is further processed to produce synthetic crude oil and other valuable commodities.

"Fines" are particles such as fine quartz and other heavy minerals, colloidal clay or silt generally having any dimension less than about 44 μm. "Coarse solids" are solids generally having any dimension greater than about 44 μm. Oil sand extraction typically involves processing ores which are relatively high in bitumen content and low in fines content. However, there exists an abundance of "poor ores" which alone yield poor bitumen recovery and consequently cannot be processed unless a high proportion of high-grade, good ores are blended into these dry ore feeds. "Poor ores" are oil sand ores generally having low bitumen content (about 6 to about 10%) and/or high fines content (greater than about 30%). In comparison, "good ores" are oil sand ores generally having high bitumen content (about 10 to about 12% or higher) and/or low fines content (less than about 20%).

Caustic is used in bitumen extraction to improve bitumen recovery and froth quality. Caustic promotes the release of natural surfactants from bitumen to the aqueous phase, precipitates divalent cations such as calcium and magnesium, modifies the electrical surface potential of bitumen and solids, adjusts the pH, and makes solids more hydrophilic, leading to better bitumen-solids separation. For an oil sand ore, there is normally an optimal caustic dosage at which the highest bitumen recovery can be obtained and the optimal dosage appears to be determined by both the fines content (Sanford, E., 1983, Can. J. Chem. Eng. 61:554-567) and the ore grade.

However, in industrial operations, the amount of caustic is typically based on ore grade only since fines content is generally inversely related to ore grade and online grade analyzers are readily available. To calculate the amount of caustic, the caustic dosing curve is defined as:

$$y=-0.087\mathrm{Ln}(x)+0.2183 \quad (I)$$

where y is the caustic dosage (wt % of oil sand) and x is the ore grade (%). The same amount of caustic is thus used for ores of the same grade regardless of their fines content. As a result, overdosing could occur for ores having lower fines content, while under-dosing could occur for ores having higher fines content. The dosing of caustic is thus not optimized, with some caustic being wasted for ores having lower fines content.

Accordingly, there is a need for an improved method of optimizing the amount of caustic used in bitumen extraction.

SUMMARY OF THE INVENTION

The current application is directed to a process of extracting bitumen from mined oil sand ores by adding a sufficient amount of caustic based on both the ore grade and fines content to condition the oil sand slurry. It was surprisingly discovered that by conducting the process of the present invention, one or more of the following benefits may be realized:

(1) The amount of caustic is optimized based on both ore grade (bitumen content, %) and fines content (% <44 μm in the solids) achieved significant improvements in bitumen extraction performance, namely bitumen recovery and froth quality.

(2) The effect of feed upsets (for example, blending upsets) on extraction performance can be minimized by the adjustment in caustic dosages by considering the changes in both ore grade and fines content.

(3) The optimized control of caustic amount can expand the operating window of acceptable ores, potentially leading to a decrease in ore blending requirements and enabling the processing of more "poor ores".

Thus, the use of the present invention optimizes the amount of caustic used in bitumen extraction to improve bitumen recovery and froth quality.

In one aspect, a process of extracting bitumen from oil sand ores having a fines content up to about 60% and a bitumen content higher than about 6% is provided, comprising:

- determining the fines content and the bitumen content of the oil sand ore;
- calculating a sufficient amount of caustic to be added in the process using an equation based on the ratio of the fines content to the bitumen content;
- mixing the oil sand ore with heated water to produce an oil sand slurry; and
- adding the sufficient amount of caustic before, during or after mixing the oil sand ore with heated water to condition the oil sand slurry and to improve bitumen recovery from the oil sand ore.

In one embodiment, the sufficient amount of caustic ranges from about 0.0 wt % to about 0.2 wt % of oil sand ore. In another embodiment, the sufficient amount of caustic is calculated using equation (1):

$$y=0.024x-0.0088 \quad (1)$$

where y is the caustic dosage (wt % of oil sand ore) and x is the ratio of the fines content (%) over the bitumen content (%). For ores with a fines content less than 6.5% or with a bitumen content greater than 13%, no caustic is generally needed. Using equation (1), the bitumen content may be about 10%, the fines content may range from about 10% to about 45%, and the caustic amount may range from about 0.016 wt % to about 0.10 wt %. In one embodiment, the bitumen content ranges from about 6% to about 13%, the fines content is about 20%, and the caustic amount ranges from about 0.07 wt % to about 0.030 wt %.

In another embodiment, the sufficient amount of caustic is calculated using equation (2):

$$y=0.012x-0.0044 \quad (2)$$

where y is the caustic dosage (wt % of oil sand ore) and x is the ratio of the fines content (%) over the bitumen content (%). Equation (2) is one half of equation (1) and can be used to still get improved bitumen extraction and bitumen froth quality over existing guidelines (using equation (I) while conserving on the amount of caustic used.

In one embodiment, caustic is sodium hydroxide.

BRIEF DESCRIPTION OF THE DRAWINGS

Referring to the drawings wherein like reference numerals indicate similar parts throughout the several views, several aspects of the present invention are illustrated by way of example, and not by way of limitation, in detail in the figures, wherein.

DETAILED DESCRIPTION OF THE PREFERRED EMBODIMENTS

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

The present invention relates generally to a process of extracting bitumen from mined oil sand ores by adding a sufficient amount of caustic based on the ore grade and fines content to condition the oil sand slurry.

In one embodiment of the process of the present invention useful in extracting bitumen from oil sand ores, oil sand is mined from an oil sand rich area such as the Athabasca Region of Alberta. The oil sand ore may comprise a fines content up to about 60% and a bitumen content greater than about 6%.

Figure 1:
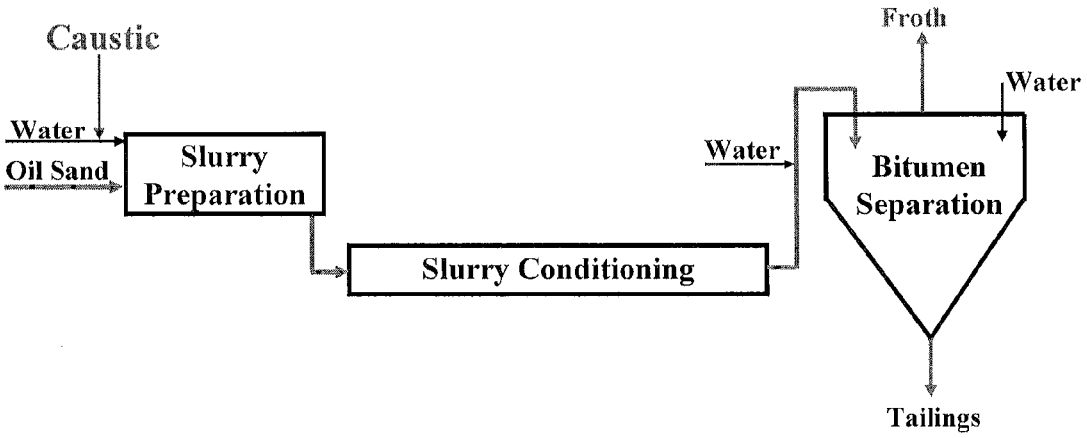
FIG. 1 is a schematic showing, in general, the extraction process for extracting bitumen from mined oil sand ore.

FIG. 1 is a general schematic of a bitumen extraction process from mined oil sand ore. The oil sand is mixed with heated water in a slurry preparation unit. The slurry preparation unit may comprise a tumbler, screening device and pump box; however, it is understood that any slurry preparation unit known in the art can be used.

In addition to the oil sand and water, caustic (sodium hydroxide) is also added to the slurry preparation unit to aid in conditioning the oil sand slurry. The amount of caustic is calculated using an equation based on both the fines content and bitumen content. In one embodiment, the caustic is added in an amount ranging from about 0.0 wt % to about 0.2 wt % of the oil sand ore. The caustic may be added to the water prior to mixing with oil sand, directly into the slurry preparation unit during mixing, or to the oil sand slurry prepared prior to hydrotransport/slurry conditioning. Preferably, the caustic is added to the heated water.

Following the addition of caustic, the oil sand slurry may be screened through a screen portion, where additional water may be added to clean the rejects (e.g., oversized rocks) prior to delivering the rejects to a rejects pile. The screened oil sand slurry is collected in a vessel such as pump box where the oil sand slurry is then pumped through a hydrotransport pipeline (slurry conditioning), which pipeline is of a adequate length to ensure sufficient conditioning of the oil sand slurry, e.g., thorough digestion/ablation/dispersion of the larger oil sand lumps, coalescence of released bitumen flecks and aeration of the coalesced bitumen droplets.

The conditioned oil sand slurry is then fed to a bitumen separation vessel (also referred to as a primary separation vessel or PSV), which bitumen separation vessel operates under somewhat more quiescent conditions to allow the bitumen droplets to rise to the top of the vessel and form bitumen froth, which froth over flows to the launder and is collected for further froth treatment. Tailings are either discarded or further treated for additional bitumen recovery.

Exemplary embodiments of the present invention are described in the following Examples, which are set forth to aid in the understanding of the invention, and should not be construed to limit in any way the scope of the invention as defined in the claims which follow thereafter.

Example 1

Figure 2:
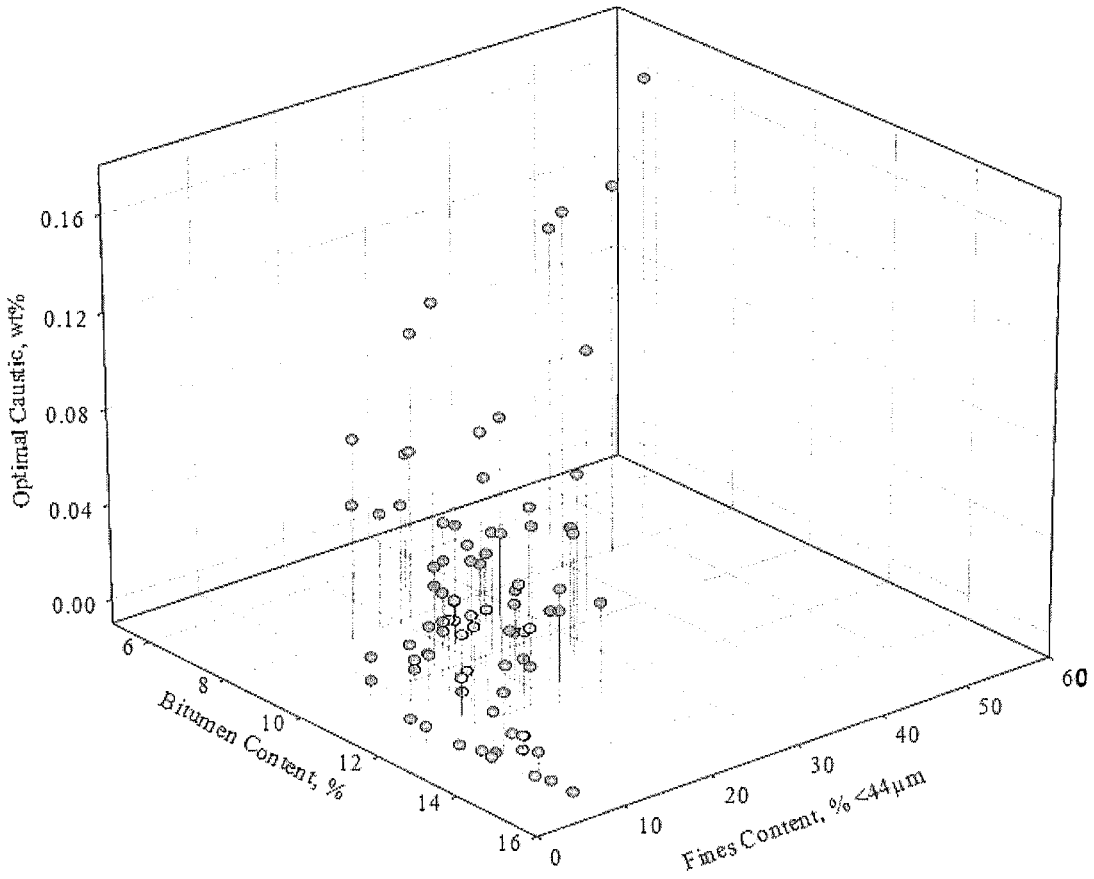
FIG. 2 is a graph showing that optimal caustic dosage (wt %) is correlated to both ore grade (bitumen content, %) and fines content (%).
Figure 3:
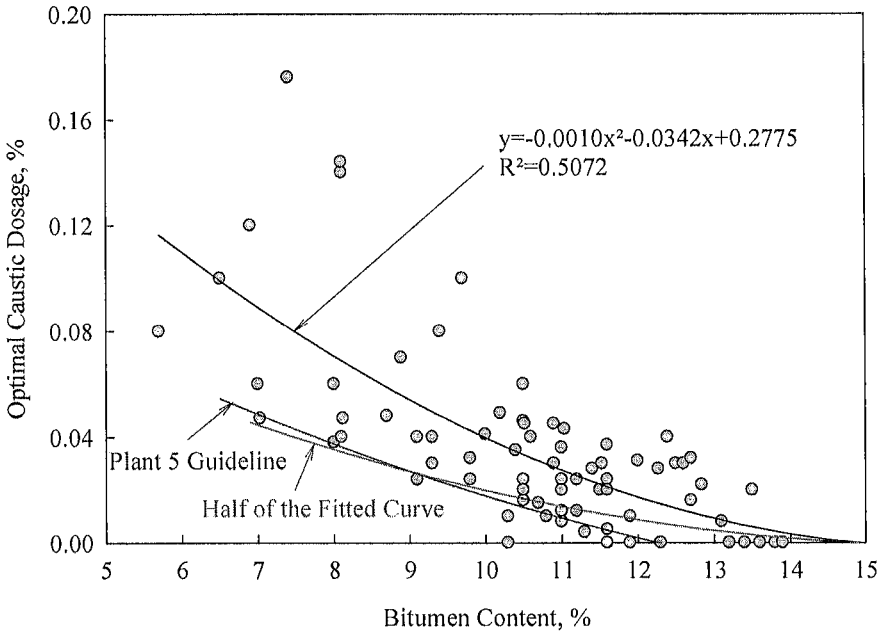
FIG. 3 is a graph showing the correlation between optimal caustic dosage (%) and ore grade (bitumen content, %).
Figure 4:
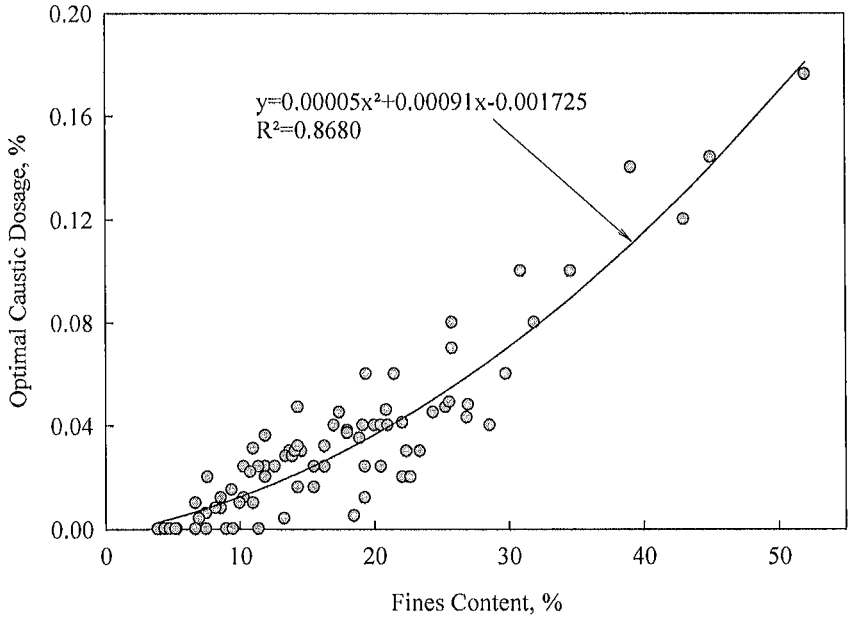
FIG. 4 is a graph showing the correlation between optimal caustic dosage (%) and ore fines content (%).

Data (including ore grade, fines content, and caustic dosage) for eighty-four oil sands were analyzed, and indicated that optimal caustic dosage (wt %) may be strongly correlated to both ore grade (bitumen content, %) and fines content (%) (FIG. 2). For ores having less than 6.5% fines content or greater than 13% ore grade, no caustic may be needed. Optimal caustic dosage appears to be generally, but not very strongly, related to ore grade (FIG. 3; $R^2$ of 0.51), and may be better correlated to fines content (FIG. 4; $R^2$ of 0.87). The existing caustic guideline (indicated as "Plant 5 Guideline" in FIG. 3) is about half of the fitted curve, likely due to the use of process water instead of city tap water as used in the tests.

Figure 5:
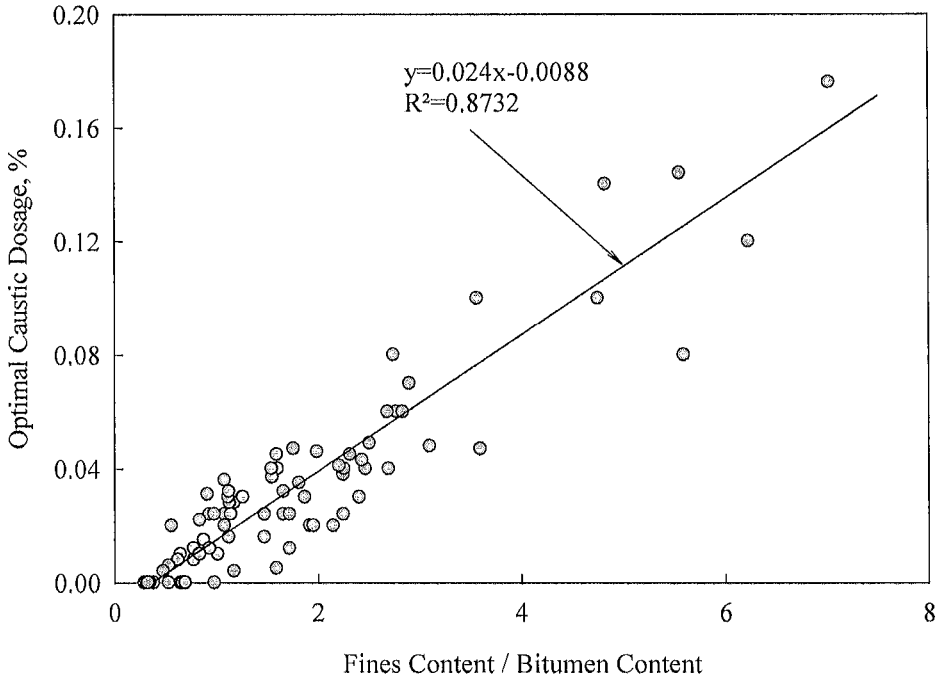
FIG. 5 is a graph showing the correlation between optimal caustic dosage (%) and the ratio of fines content (%) over bitumen content (%).

It was surprisingly discovered that optimal caustic dosages are well correlated to the ratio of fines content to ore grade (FIG. 5; $R^2$ of 0.87). Based on all of the test results, it was discovered that the amount of caustic to be added can be calculated using the following equation:

$$y=0.024x-0.0088 \quad (1)$$

where y is the caustic dosage (wt % of oil sand) and x is the ratio of ore fines content (%) over ore grade (%).

One embodiment of the invention contemplates using half of the amount from the fitted curve of FIG. 5 as defined in the following equation:

$$y=0.012x-0.0044 \quad (2)$$

where y is the caustic dosage (wt % of oil sand) and x is the ratio of ore fines content (%) over ore grade (%).

Figure 6:
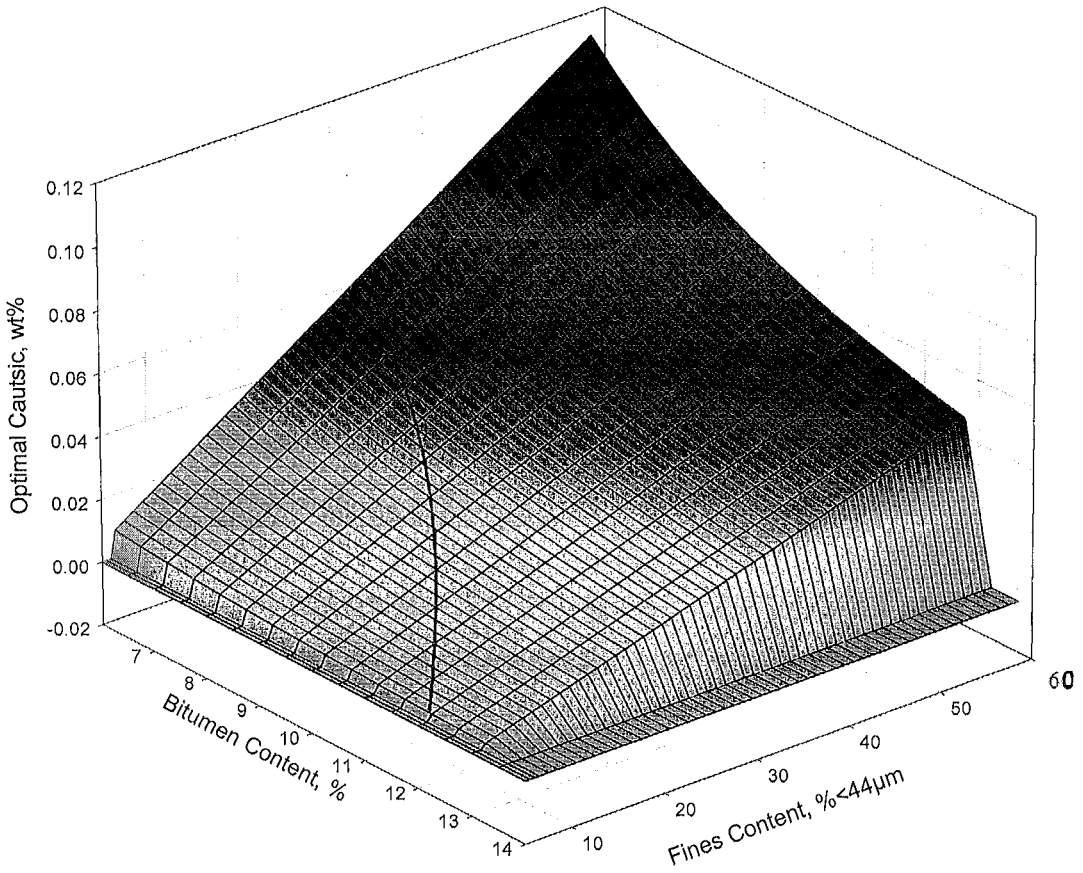
FIG. 6 is a graph showing caustic dosing based on both ore grade (%) and fines content (%) using equation (2).
Figure 7:
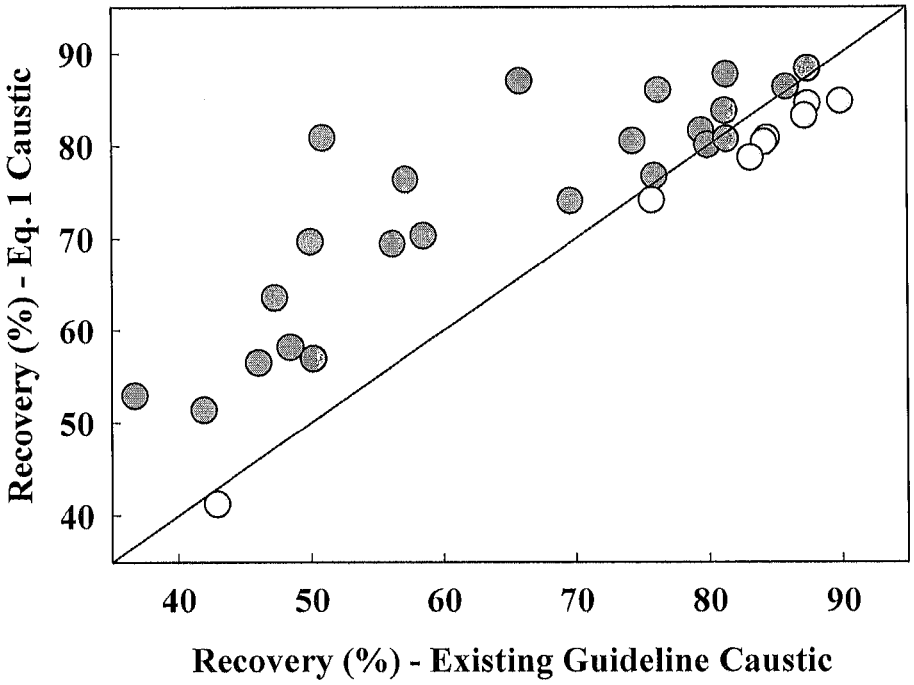
FIG. 7 is a graph comparing the bitumen recovery (%) of proposed caustic using equation (1) to the existing guideline caustic.
Figure 8:
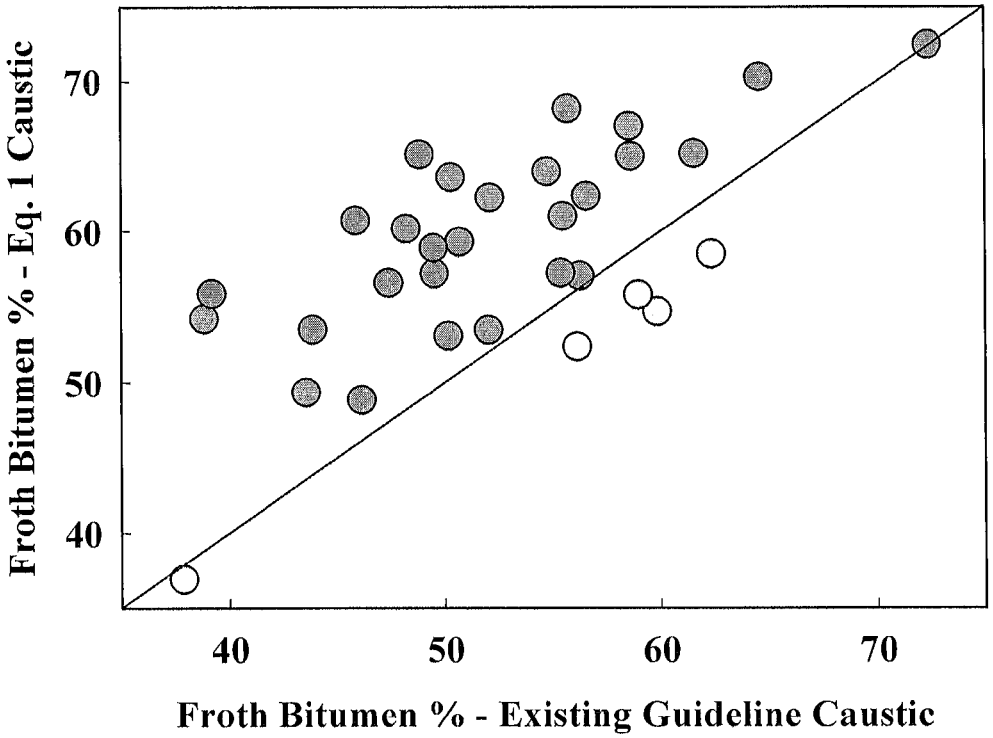
FIG. 8 is a graph comparing the froth quality (bitumen content in wt %) of proposed caustic using equation (1) to the existing guideline caustic.
Figure 9:
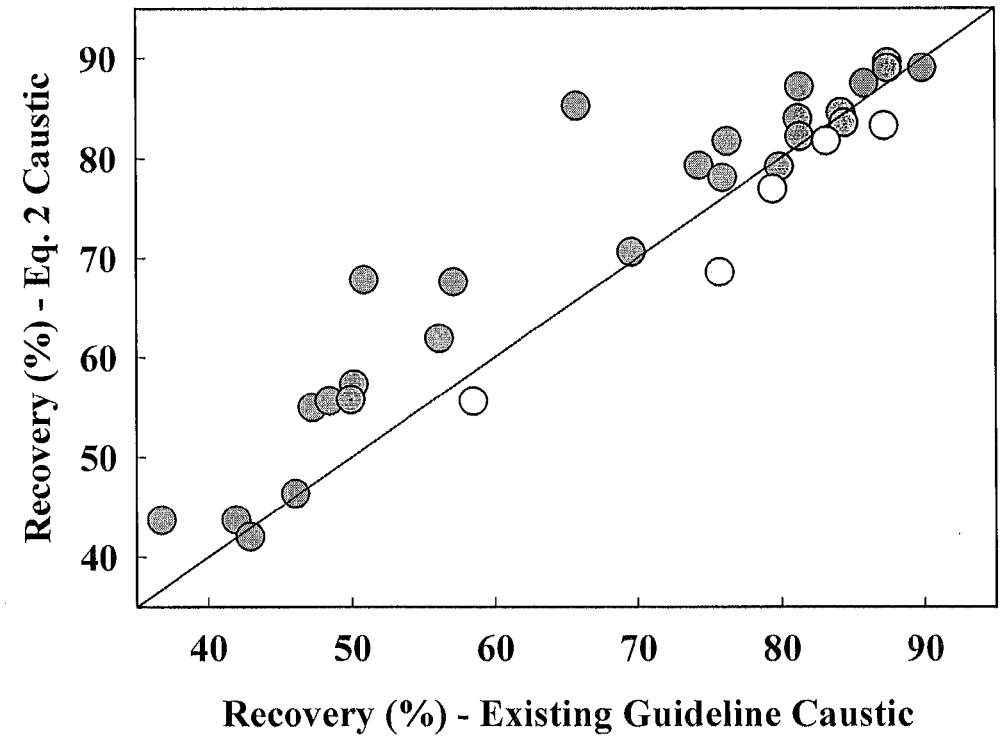
FIG. 9 is a graph comparing the bitumen recovery (%) of proposed caustic using equation (2) to the existing guideline caustic.
Figure 10:
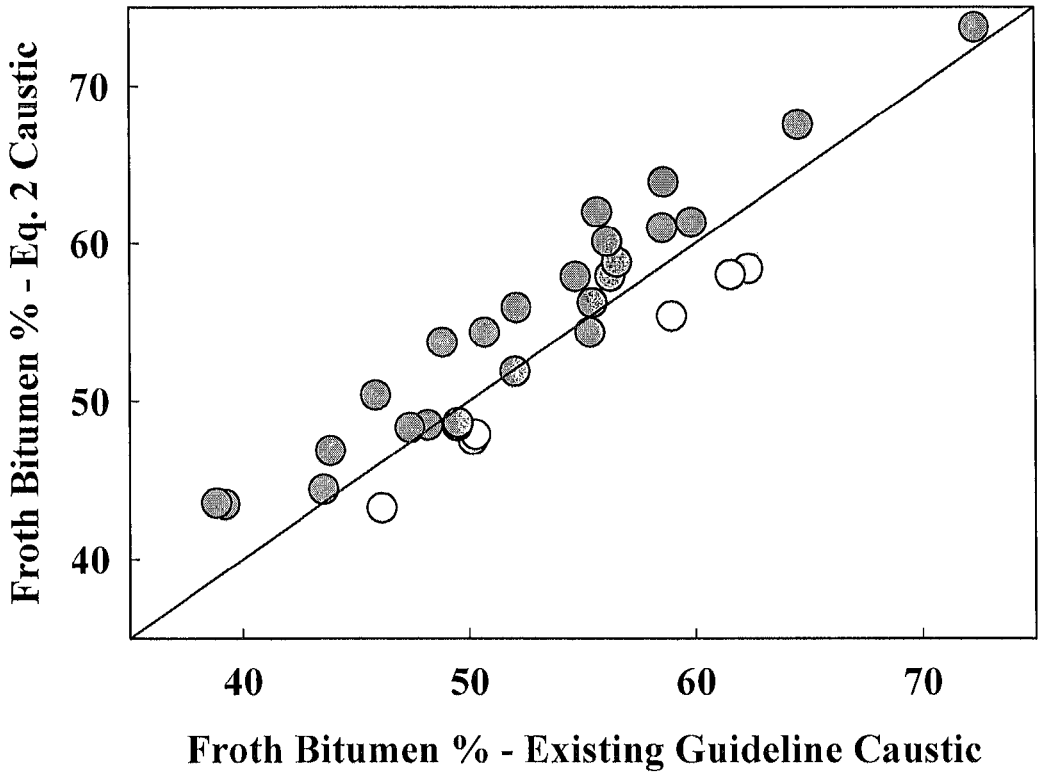
FIG. 10 is a graph comparing the bitumen froth quality (bitumen content in wt %) of proposed caustic using equation (2) to the existing guideline caustic.

Caustic dosage (wt %) based on both ore grade (bitumen content, %) and fines content (%) with equation (2) is further shown in FIG. 6. For a bitumen content of 10%, the existing guideline requires a caustic addition of 0.018% at any fines content. In contrast, the present invention determines the amount of caustic is based upon both ore grade and fines content. Examples are set out in Table 1 (using equation (2)). Thus, if the ores share the same fines content (see the 20% fines content examples), the caustic dosage is determined by the ore grade. Similarly, if the ores share the same bitumen content (see the 10% bitumen content examples), the caustic dosage is determined by the fines content.

TABLE 1

| Bitumen content (%) | Fines content (%) | Caustic (wt %) | Fines content (%) | Bitumen content (%) | Caustic (wt %) |
|---|---|---|---|---|---|
| 10 | 10 | 0.008 | 20 | 7 | 0.030 |
| 10 | 18.7 | 0.018 | 20 | 8 | 0.026 |
| 10 | 25 | 0.026 | 20 | 9 | 0.022 |
| 10 | 35 | 0.038 | 20 | 10 | 0.020 |
| 10 | 45 | 0.050 | 20 | 11 | 0.017 |

Batch extraction unit testing was conducted, using blended process water, conducting conditioning at 55° C., and testing three caustic levels (existing guideline, invention equation (1), and invention equation (2) (half of invention equation (1)). The results show that the above correlations based on both ore grade and fines content clearly improved bitumen recovery when compared to the existing guideline (FIGS. 7 to 10). While using the amount of caustic calculated from equation (1) gave greater bitumen recovery (FIG. 7) and improved bitumen froth quality (higher bitumen content in the froth, FIG. 8), it can still be seen that use of equation (2) still resulted in substantial improvement in bitumen recovery (FIG. 9) and bitumen froth quality (FIG. 10) over the standard guidelines that only take into account bitumen content.

Table 2 further shows that the amount of caustic to be added to a 10% bitumen oil sand ore varies considerably when factoring in fines content, especially when compared to existing guidelines where only the bitumen content is taken into account.

TABLE 2

| | | Caustic Dosage, wt % | | |
|---|---|---|---|---|
| % Bitumen | % Fines | Existing Guideline | Eq. (1) | Eq. (2) |
| 10 | 10 | 0.018 | 0.015 | 0.008 |
| 10 | 18.7 | 0.018 | 0.036 | 0.018 |
| 10 | 25 | 0.018 | 0.051 | 0.026 |
| 10 | 35 | 0.018 | 0.075 | 0.038 |
| 10 | 45 | 0.018 | 0.099 | 0.050 |

Existing guidelines would suggest that for any oil sand ore having 10% bitumen content, 0.018 wt % of caustic should be added. However, it can be seen that almost five (5) times that amount should be added if the 10% grade ore also has 45% fines (when using equation (1)) or at least two and a half (2½) times more caustic should be added (when using equation (2)). On the other hand, less caustic will be used if the 10% grade ore has a low fines content (for example, 10%) as shown in Table 2.

From the foregoing description, one skilled in the art can easily ascertain the essential characteristics of this invention, and without departing from the spirit and scope thereof, can make various changes and modifications of the invention to adapt it to various usages and conditions. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims.

I claim:

1. A process of extracting bitumen from oil sand ores having a fines content up to about 60% and a bitumen content greater than about 6%, comprising:

determining the fines content of the oil sand ore prior to mixing the oil sand ore with heated water;

determining the bitumen content of the oil sand ore prior to mixing the oil sand ore with heated water;

mixing the oil sand ore with heated water to produce an oil sand slurry; and adding caustic before, during or after mixing the oil sand ore with heated water in an amount responsive to the content of fines and bitumen in the oil sand ore to condition the oil sand slurry and to improve bitumen recovery from the oil sand ore, wherein the amount of caustic to be added is determined using equation (1):

$$y=0.024x-0.0088 \quad (1),$$

where (y) is the caustic dosage (wt % of oil sand ore) and x is the ratio of the fines content (%) over bitumen content (%).

2. The process of claim 1, wherein the bitumen content is about 10%, the fines content ranges from about 10% to about 45%, and the amount of caustic added ranges from about 0.016 wt % to about 0.10 wt %.

3. The process of claim 1, wherein the bitumen content ranges from about 6% to about 13%, the fines content is about 20%, and the amount of caustic added ranges from about 0.07 wt % to about 0.03 wt %.

4. The process of claim 1, wherein when the fines content is constant, the amount of caustic added decreases as the bitumen content increases.

5. The process of claim 1, wherein when the bitumen content is constant, the amount of caustic added increases as the fines content increases.

6. A process of extracting bitumen from oil sand ores having a fines content up to about 60% and a bitumen content greater than about 6%, comprising:

determining the fines content and-the bitumen content of the oil sand ore prior to mixing the oil sand ore with heated water;

determining the bitumen content of the oil sand ore prior to mixing the oil sand ore with heated water;

mixing the oil sand ore with heated water to produce an oil sand slurry; and adding caustic before, during or after mixing the oil sand ore with heated water in an amount responsive to the content of fines and bitumen in the oil sand ore to condition the oil sand slurry and to improve bitumen recovery from the oil sand ore, wherein the amount of caustic to be added is determined using equation (2):

$$y=0.012x-0.0044 \quad (2),$$

where (y) is the caustic dosage (wt % of oil sand ore) and x is the ratio of the fines content (%) over bitumen content (%).

7. The process of claim 6, wherein the bitumen content ranges from about 6% to about 13% and the fines content is about 20%, the amount of caustic added decreases from about 0.036 wt % to about 0.014 wt % as the bitumen grade increases.

8. The process of claim 6, wherein when the fines content ranges from about 10% to about 45% and the bitumen content is about 10%, the amount of caustic added increases from about 0.008 wt % to about 0.050 wt %.

* * * * *